US005419021A

United States Patent [19]

Seroogy

[11] Patent Number: 5,419,021

[45] Date of Patent: May 30, 1995

[54] TELESCOPING SLOT NOZZLE

[75] Inventor: Paul Seroogy, Greenbay, Wis.

[73] Assignee: W.R. Grace & Co.-Conn., New York, N.Y.

[21] Appl. No.: 49,759

[22] Filed: Apr. 20, 1993

[51] Int. Cl.[6] ..... D06C 7/00

[52] U.S. Cl. ..... 26/92; 26/106; 34/646

[58] Field of Search ..... 26/92, 106, 1, 51, 89, 26/91; 34/156, 158, 629, 636, 638, 639, 658, 646

[56] References Cited

U.S. PATENT DOCUMENTS

| | | | |
|---|---|---|---|
| 347,212 | 8/1886 | Varney . | |
| 1,531,826 | 3/1925 | Wigglesworth | 26/92 |
| 1,799,301 | 4/1931 | Kenyon | 26/92 |
| 1,997,696 | 4/1935 | Parkes | 26/106 |
| 2,270,155 | 5/1940 | Willen . | |
| 2,495,163 | 1/1950 | Dungler | 26/92 |
| 2,894,334 | 7/1959 | Thygeson, Sr. | 34/158 |
| 2,916,796 | 8/1955 | Sibel . | |
| 3,021,609 | 4/1958 | Parkes et al. | 34/158 |
| 3,344,969 | 10/1967 | Collinge et al. | 26/106 |

FOREIGN PATENT DOCUMENTS

| | | | |
|---|---|---|---|
| 578735 | 7/1946 | United Kingdom . | |
| 2002100 | 2/1979 | United Kingdom | 34/158 |

*Primary Examiner*—Clifford D. Crowder
*Assistant Examiner*—Amy B. Vanatta
*Attorney, Agent, or Firm*—Kevin S. Lemack; William L. Baker; Craig K. Leon

[57] ABSTRACT

Telescoping slot nozzles for use with a rail assembly are disclosed. Each nozzle includes a fixed portion and at least one telescoping portion slidably guided in the fixed portion. Metal-to-metal contact in the nozzle is avoided, thereby allowing the nozzles to operate at high temperatures. The configuration of the nozzle discharge opening can be easily modified to form an air knife, depending upon the particular application. Each nozzle is independent of the others, thereby facilitating retrofitting existing ovens and maintenance of individual nozzles.

7 Claims, 5 Drawing Sheets

TELESCOPING SLOT NOZZLE

BACKGROUND OF THE INVENTION

In the production of oriented film, for example, the film is transported through an oven that will heat and/or cool the film. A typical oven consists of slot nozzles which provide convective heat transfer by air impinging on the film, and mechanical means (such as a tenter) for transporting and stretching the film. The tenter consists of clips that clamp to the edge of the film and rails that guide the clips through the oven. The distance between rails is typically adjustable to allow for the production of different width films and different stretch rates.

In order to allow for the adjustment of the rails depending on the film width, the slot nozzles, which are arranged on either side of the plane of travel of the film, are positioned above and below the rails. As a result, nozzle-to-film distances are less than optimum, sometimes being as much as sixteen (16) inches apart. As the nozzle-to-film distance increases, the heat transfer coefficient and uniformity decreases, thereby resulting in an inefficient oven and poorer quality film.

In response to problems similar to the foregoing, U.S. Pat. Nos. 2,270,155 and 2,495,163 disclose the use of nozzles having variable lengths according to the width of a cloth being treated. The nozzles include a fixed part corresponding to the minimum width of the cloth to be treated, and extensions slidably mounted on the fixed part, which are responsive to the movements of the chain-guide rails. As a result, the nozzles need not be located above and below the top and bottom rails, respectively, but instead can be located in the same planes as the rails.

The present invention is directed to an improved telescoping slot nozzle for tenter frames as hereinafter described.

SUMMARY OF THE INVENTION

The problems of the prior art have been solved by the present invention, which provides telescoping slot nozzles for use with a rail assembly. Each nozzle includes a fixed portion and at least one telescoping portion slidably guided in the fixed portion. Metal-to-metal contact in the nozzle is avoided, thereby allowing the nozzles to operate at high temperatures. The configuration of the nozzle discharge opening can be easily modified to form an air knife, depending upon the particular application. Each nozzle is independent of the others, thereby facilitating retrofitting existing ovens and maintenance of individual nozzles.

DETAILED DESCRIPTION OF THE INVENTION

Figure 1:
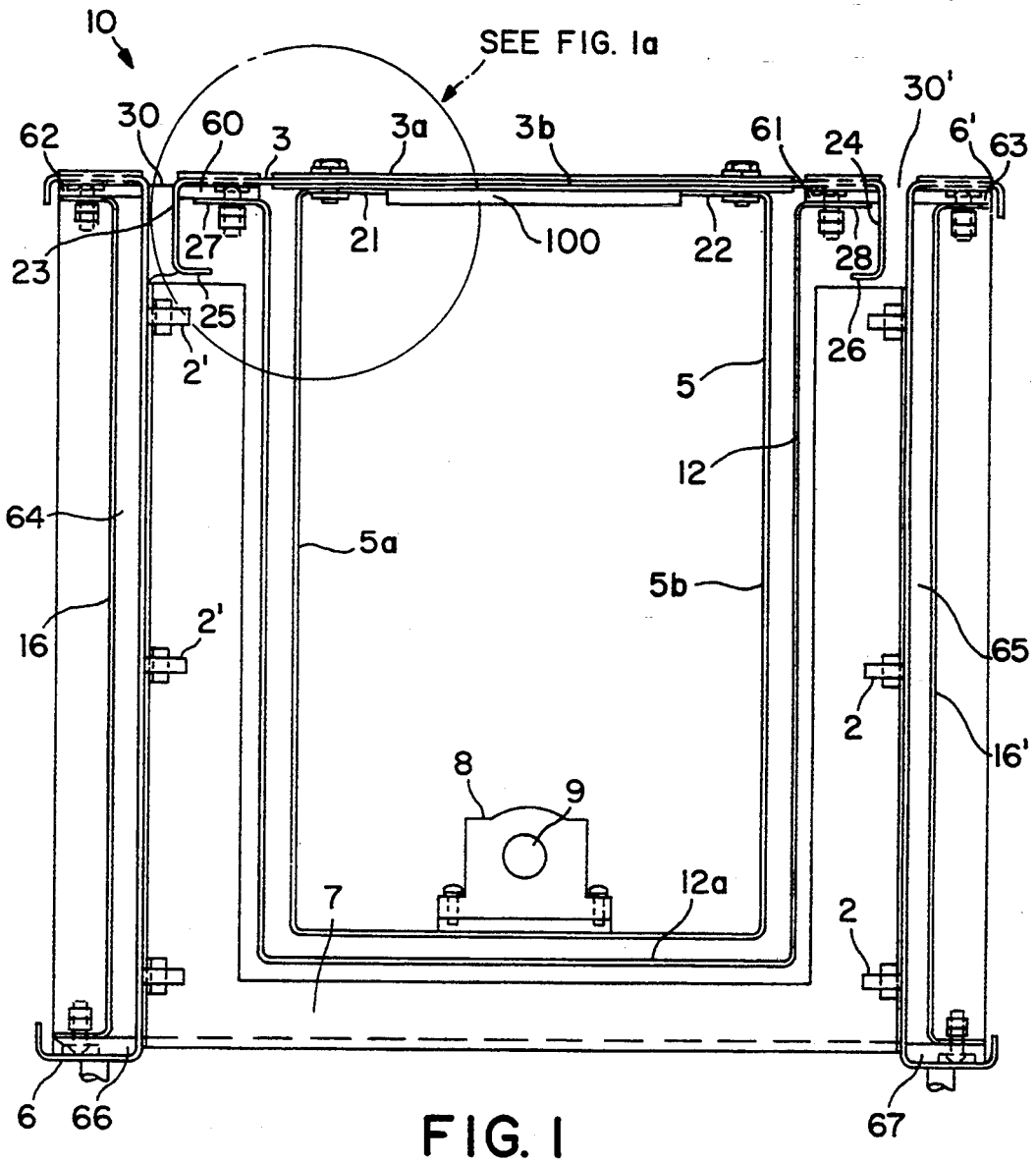
FIG. 1 is a front cross-sectional view of a telescoping nozzle in accordance with a first embodiment of the present invention.
Figure 1A:
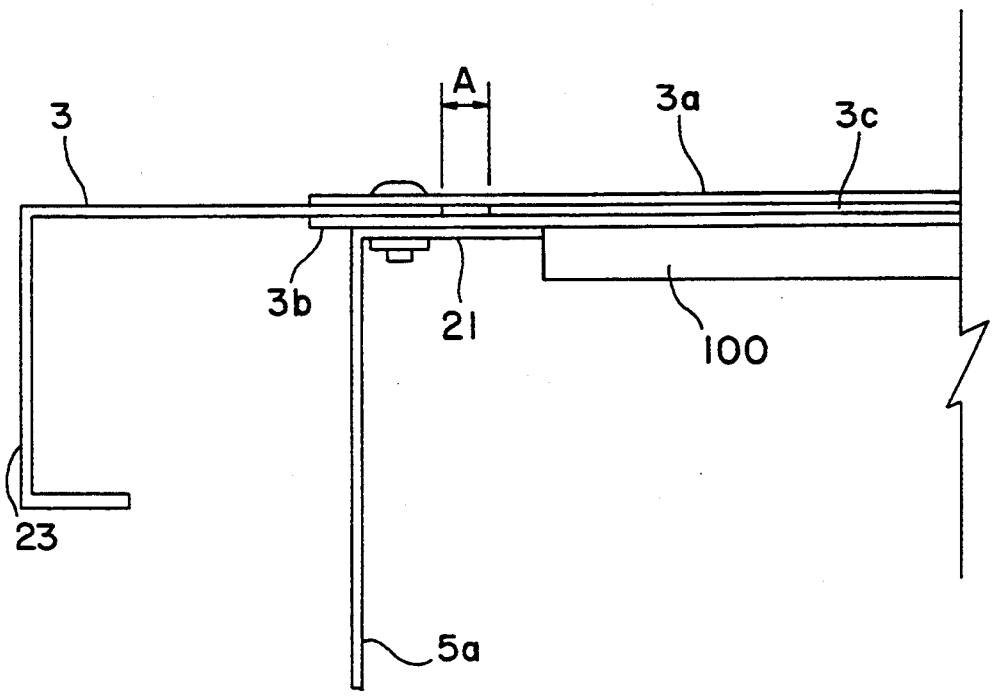
FIG. 1*a* is an enlarged view of the portion of FIG. 1 encircled.

Turning now to FIG. 1, there is generally shown a telescoping slot nozzle 10. The nozzle 10 has a pair of slot nozzle side channels 6, 6' which are bent at their upper and lower ends in a U-shape so as to hold wear strips 62, 63, 66 and 67, preferably made of Teflon, and to form a track for purposes to be discussed below. The side channels 6, 6' are affixed to slot nozzle stiffener base 7 via a plurality of studs 2, 2' provided on the side channels 6, 6'. Return air channel 5 is substantially centrally located in the nozzle 10, and includes a plurality of guide shaft-receiving members 8 having apertures 9. Return air channel 5 is substantially U-shaped, having a pair of top flanges 21, 22 dimensioned so as to receive therebetween top support 100 (best seen in-FIG. 1*a*). An adjustable slot plate has a main body 3 extending over return air channel 5 and includes side bends 23, 24 which terminate in flange portions 25, 26, respectively. The slot plate 3 is adjustable during assembly to modify the dimensions of the nozzle gap, and is then sandwiched between two pieces of sheet metal 3*a*, 3*b* and secured in place (such as with bolts). As best seein in FIG. 1*a*, a space "A" is shown between slot plate 3 and sheet 3*c* allowing for linear adjustment of slot plate 3. Slot plate 3 has a plurality of spaced slotted holes for securing it in place once the linear adjustment is completed. The nozzle gap is defined by slot plate 3 and side channels 6, 6' to form fixed gap 30, 30'. One suitable dimension for each of fixed gaps 30, 30' is 0.39 inches, although it will be understood by those skilled in the art that the gap size can vary considerably depending upon the particular requirements of the application.

The telescoping portion of nozzle 10 includes a U-shaped sliding exterior return air channel 12 coupled to sliding external extensions 16 and 16' via an end plate (not shown). Sliding exterior return air channel 12 slidingly fits about return air channel 5 as shown, and includes flange portions 27, 28 bent away from portions 21 and 22, respectively, of return air channel 5. The flange portions 27, 28 of sliding exterior return air channel 12 are confined within the spaces defined by the exterior of side walls 5*a*, 5*b* of the return air channel 5 and the bent portions 23, 24 of the slot plate 3. Sliding exterior return air channel 12 includes a centrally located guide shaft 17 (FIG. 2) extending longitudinally in said air channel 12 and affixed at one end of the air channel base portion 12*a* with a holding bracket 18 so that the guide shaft is in the same plane as the apertures 9 of guide shaft receiving members 8*a*, 8*b* affixed to the return air channel 5. The guide shaft is of a suitable diameter so as to be slidingly received by said aperture 9, and is preferably longer than the length of the air channel 12. Preferably at least two guide shaft receiving members 8*a*, 8*b* are provided for each guide shaft 17.

Figure 2:
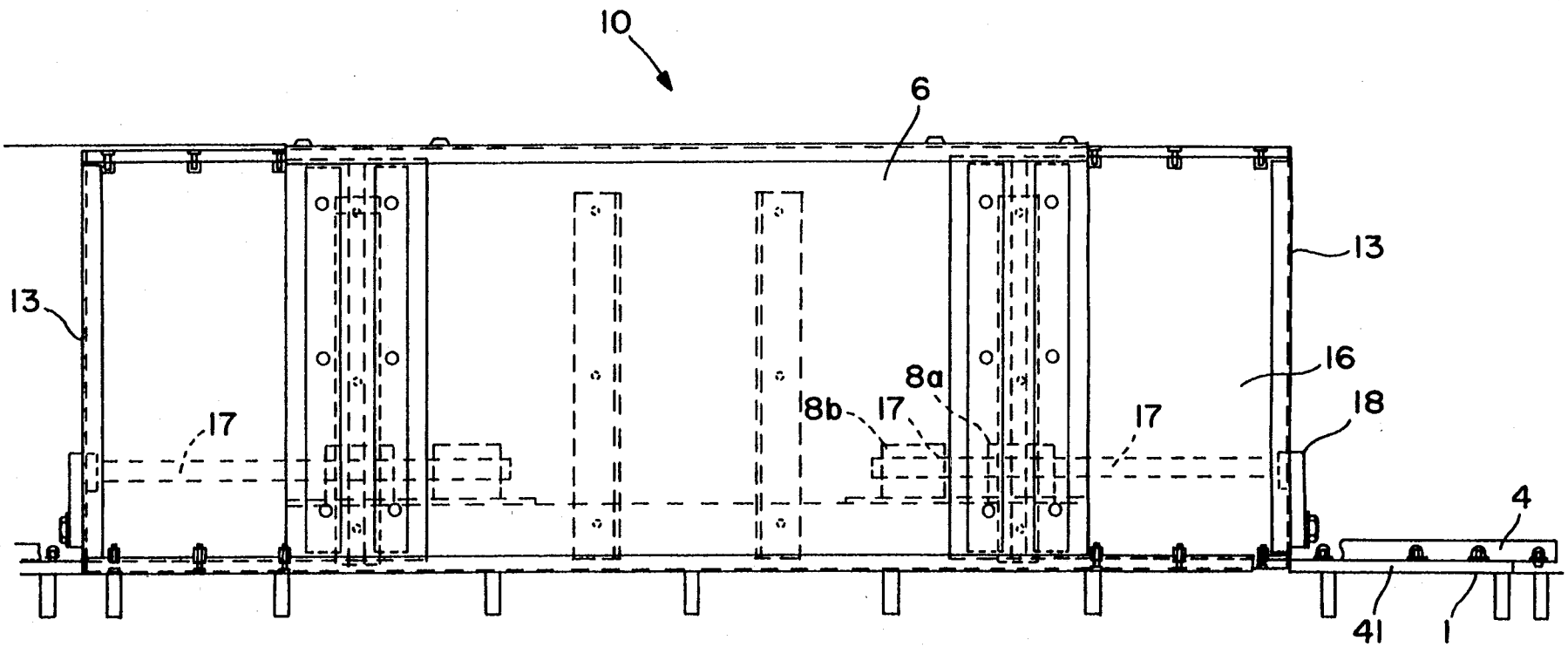
FIG. 2 is a side view of the telescoping nozzle of FIG. 1.
Figure 3:
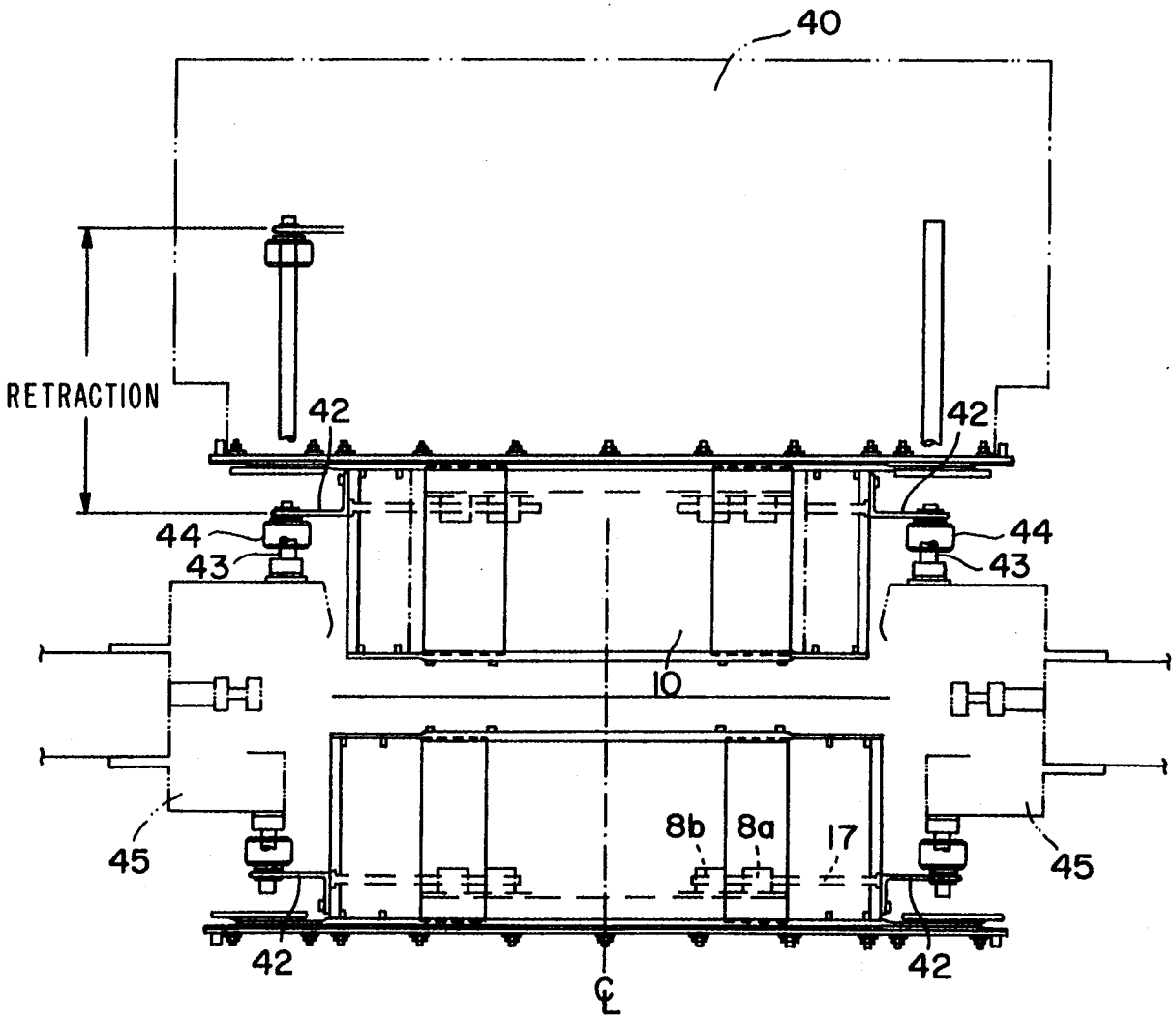
FIG. 3 is a side view of the telescoping nozzles of the present invention shown attached to a rail assembly.

Sliding external extensions 16, 16' are coupled to exterior return air channel 12 via a U-shaped end plate 13 (FIG. 2) so that a pair of slots 30, 30' are formed therebetween to slidingly receive side slot nozzle channels 6, 6' and through which air is expelled so as to impinge upon the web. A suitable slot width for the telescoping portion is 0.49 inches, although it again will be understood by those skilled in the art that the width can vary considerably depending upon the particular application. The slot width of the telescoping portion is slightly larger than the fixed gap width, since the telescoping portion fits within the framework of the fixed portion and therefore must accommodate its dimensions. With particular reference to FIG. 2, where like numerals correspond to elements previously described, nozzle plate cover 1 includes a plurality of studs for coupling of the nozzle to a header assembly 40 (FIG. 3). Gasket plate cover 4 holds a Teflon covered fiberglass gasket 41 in place as shown.

Turning now to FIG. 3, where like numerals correspond to elements previously described, nozzle 10 is shown coupled to header assembly 40 and rail assembly 45. A right-angle bracket 42 is bolted to each side of nozzle 10 and to a telescoping nozzle support tube 44, preferably made of aluminum. All of the nozzles are coupled together by the support tube 44, although each nozzle can be removed individually. This is highly advantageous in the event any particular nozzle or nozzles has to be replaced, cleaned, modified, etc. Each support tube 44 is connected to a guide rod assembly 43 of rail 45. All connections are slotted in the tube direction to allow the rails to move angularly. It will be readily appreciated by those skilled in the art that as the rail assembly 45 as depicted in FIG. 3 moves laterally in accordance with the particular width of the web being treated, it carries with it the telescoping portions of nozzle 10.

One important aspect of the present invention is the absence of any metal-to-metal contact in the nozzle 10. As a result, the nozzles are capable of efficient operation up to temperatures of about 500° F. To this end, Teflon or similar means is used between sliding metal surfaces to reduce friction and to minimize heat transfer therebetween. For example, flange portions 27, 28 of sliding exterior return air channels 12 are covered with Teflon wear strips 60, 61, as are the inner portions of each slot nozzle side channel 6, 6' that function as a track for exterior extensions 16, 16', as shown by elements 62–67 in FIG. 1. Elements 64 and 65 in particular are a Teflon-coated fiberglass cloth gasket that is sewn to a stainless steel hollow core mesh. The Teflon wear strips actually define the slot through which air is expelled from the telescoping portions of the nozzle. Also, the Teflon-coated fiberglass cloth gasket is placed between the return air channel 5 and the exterior return air channels 12. This gasket prevents air leakage and takes up any inconsistencies in manufacturing.

The minimum and maximum dimensions of the telescoping slot nozzle of the present invention are variable, depending upon the particular tenter system for which they are designed. The only limitation in these dimensions is that the sum of the telescoping portion dimensions has to be less than the fixed portion dimensions.

Figure 4:
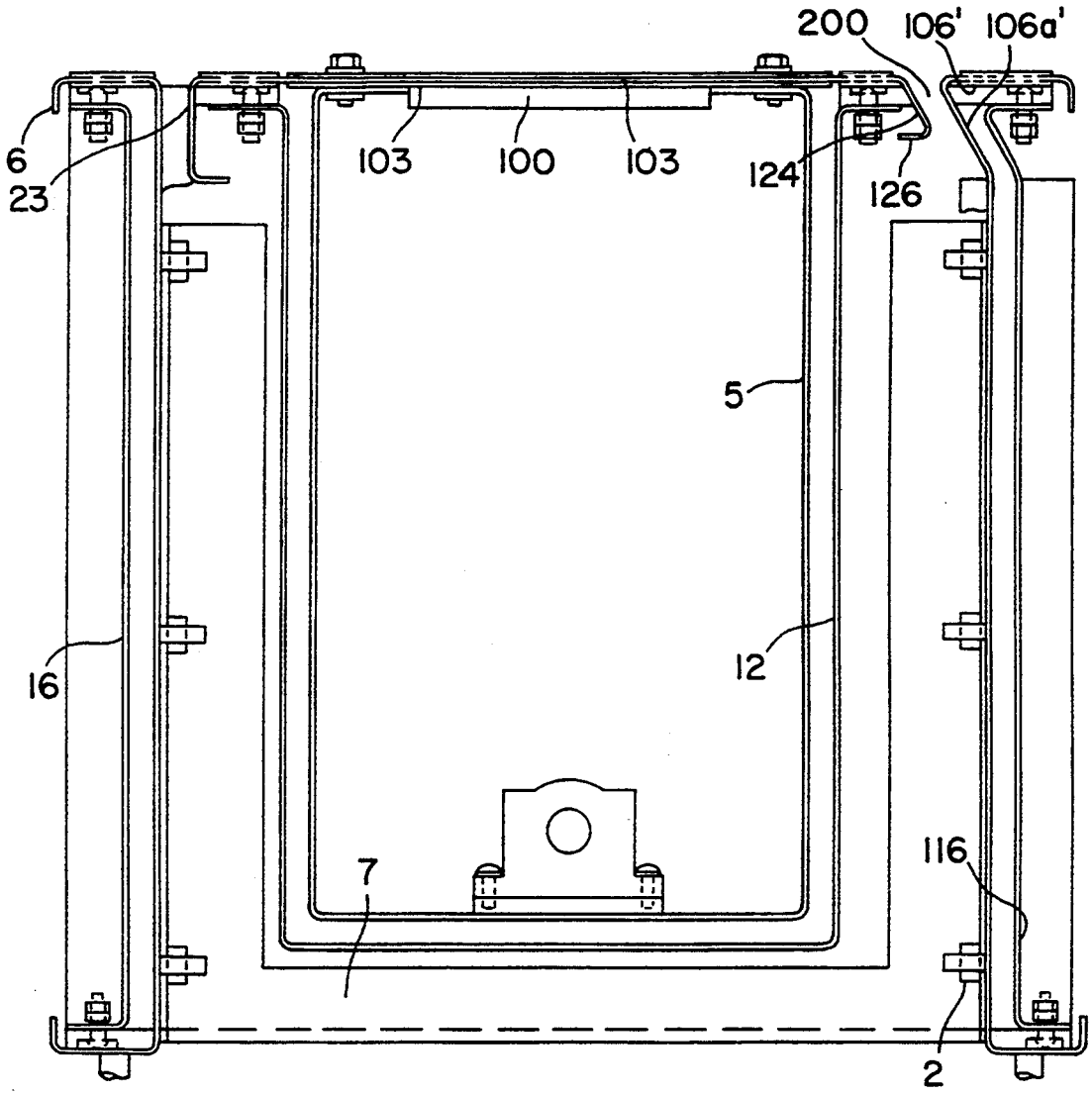
FIG. 4 is a front cross-sectional view of a telescoping nozzle in accordance with a second embodiment of the present invention.

FIG. 4 illustrates a second embodiment of the present invention, where like numerals correspond to elements previously described. In this second embodiment, the configuration of one of the nozzles is in the form of an air knife. Specifically, one side of slot plate 103 includes an angled side bend 124 terminating in flange portion 126. A corresponding angled portion **106*a'* is formed on air bar channel side 106' to define with angled side bend 124 air knife 200. The slot plate 3 is adjustable during assembly to modify the dimensions of the air knife or of the nozzle gap formed on the other side by slot nozzle channel side 6 and side bend 23**, or both. It will be readily appreciated by those skilled in the art that one or both discharge openings can be designed as air knives.

What is claimed is:

1. A telescoping nozzle for heating, cooling or drying a web, comprising:

(a) a fixed portion defined by a substantially centrally located inner return air channel coupled to a pair of side channels and a top slot plate on said return air channel, said slot plate defining with each of said side channels a pair of fixed discharge gaps;

(b) a telescoping portion defined by an exterior return air channel dimensioned to slide about said inner return air channel, and a pair of exterior extensions coupled to said exterior return air channel, and dimensioned to slide about a respective side channel, said exterior return air channel defining with each of said extensions a telescoping discharge gap.

2. The telescoping nozzle of claim 1, wherein said exterior return air channel comprises at least one guide shaft, and wherein said inner return air channel comprises at least one guide shaft receiving member for slidingly receiving said guide shaft, thereby allowing said telescoping portion to slide within said fixed portion.

3. The telescoping nozzle of claim 1, wherein said exterior return air channel, said inner return air channel, said exterior extensions and said side channels are formed of metal, and further comprising means between said exterior air channel and said inner return air channel, and between said exterior extensions and said side channels to eliminate metal-to-metal contact and minimize heat transfer.

4. The telescoping nozzle of claim 1, wherein said side channels are coupled to said inner return air channel by a stiffener base.

5. The telescoping nozzle of claim 1, wherein at least one of said fixed and one of said telescoping discharge gaps are shaped to form an air knife.

6. A tenter system in a housing, comprising a rail assembly having a plurality of clips for securing to a web and guiding said web through said housing, and a plurality of telescoping slot nozzles removably affixed to said rail assembly, each of said slot nozzles comprising:

(a) a fixed portion defined by a substantially centrally located inner return air channel coupled to a pair of side channels and a top slot plate on said return air channel, said slot plate defining with each of said side channels a pair of fixed discharge gaps; and (b) a telescoping portion defined by an exterior return air channel dimensioned to slide about said inner return air channel, and a pair of exterior extensions coupled to said exterior return air channel, and dimensioned to slide about a respective side channel, said exterior return air channel defining with each of said extensions a pair of telescoping discharge gaps.

7. The tenter system of claim 6, wherein each of said slot nozzles is independent of the others.

* * * * *